US009283970B2

(12) United States Patent
Wusching

(10) Patent No.: US 9,283,970 B2
(45) Date of Patent: Mar. 15, 2016

(54) DRIVE ARRANGEMENT FOR A RUNNING GEAR

(71) Applicant: Bombardier Transportation GmbH, Berlin (DE)

(72) Inventor: Michael Wusching, Wilthen (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 14/402,874

(22) PCT Filed: May 29, 2013

(86) PCT No.: PCT/EP2013/061136

§ 371 (c)(1),
(2) Date: Nov. 21, 2014

(87) PCT Pub. No.: WO2013/178720

PCT Pub. Date: Dec. 5, 2013

(65) Prior Publication Data

US 2015/0107486 A1 Apr. 23, 2015

(30) Foreign Application Priority Data

May 30, 2012 (EP) ..... 12170117

(51) Int. Cl.
*B61F 3/16* (2006.01)

(52) U.S. Cl.
CPC ..... *B61F 3/16* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,403,288 | A | | 1/1922 | Cadmus, Jr. |
| 4,047,770 | A | * | 9/1977 | Korenhof et al. ..... 384/482 |
| 4,102,443 | A | * | 7/1978 | Kohler et al. ..... 188/218 XL |
| 5,328,252 | A | * | 7/1994 | Thompson ..... 301/64.305 |
| 5,328,275 | A | * | 7/1994 | Winn et al. ..... 384/472 |
| 5,775,229 | A | * | 7/1998 | Folk et al. ..... 105/157.1 |
| 5,813,938 | A | * | 9/1998 | Forster ..... 475/331 |
| 5,890,567 | A | * | 4/1999 | Pete et al. ..... 188/218 R |
| 5,904,102 | A | * | 5/1999 | Brinkmann et al. ..... 105/96 |
| 5,915,306 | A | * | 6/1999 | Langhorst et al. ..... 105/157.1 |
| 5,957,058 | A | * | 9/1999 | Dampmann et al. ..... 105/96.1 |
| 6,343,554 | B1 | | 2/2002 | Affeldt et al. |

(Continued)

FOREIGN PATENT DOCUMENTS

| | | | |
|---|---|---|---|
| CN | 1882465 | A | 12/2006 |
| CN | 102171466 | A | 8/2011 |

(Continued)

*Primary Examiner* — Jason C Smith
(74) *Attorney, Agent, or Firm* — The Webb Law Firm

(57) ABSTRACT

The present invention relates to a drive arrangement for a wheel unit including a wheel unit defining an axial direction and a radial direction, a first torque transmission device and a second torque transmission device. The first torque transmission device is connected in a torsionally rigid manner to the wheel unit and the second torque transmission device is connected in a torsionally rigid manner to the first torque transmission device using a connecting device such that an arrangement substantially coaxial to the axial direction is formed. The wheel unit has a wheel unit end section protruding, along the wheel axis, into a receptacle of the second torque transmission device. A protective unit is arranged between the wheel unit end section and the second torque transmission device, the protective unit being configured to protect the wheel unit end section against damage by the second torque transmission device.

15 Claims, 2 Drawing Sheets

(56) References Cited

U.S. PATENT DOCUMENTS

| | | | | |
|---|---|---|---|---|
| 6,598,919 | B2 * | 7/2003 | Bradley et al. | 295/1 |
| 2002/0189490 | A1 * | 12/2002 | Kasprzyk et al. | 105/96 |
| 2015/0107486 | A1 * | 4/2015 | Wusching | 105/96.1 |
| 2015/0108701 | A1 * | 4/2015 | Wolf et al. | 267/292 |
| 2015/0144025 | A1 * | 5/2015 | Zanutti | 105/413 |

FOREIGN PATENT DOCUMENTS

| | | | |
|---|---|---|---|
| CN | 203254884 | U | 10/2013 |
| DE | 3120105 | A1 | 5/1982 |
| EP | 0288589 | A1 | 11/1988 |
| EP | 0626286 | A2 | 11/1994 |
| EP | 0943519 | A2 | 9/1999 |

* cited by examiner

DRIVE ARRANGEMENT FOR A RUNNING GEAR

CROSS-REFERENCE TO RELATED APPLICATIONS

This application is the United States national phase of International Application No. PCT/EP2013/061136 filed May 29, 2013, and claims priority to European Patent Application No. 12170117.1 filed May 30, 2012, the disclosures of which are hereby incorporated in their entirety by reference.

FIELD OF THE INVENTION

Background of the Invention

The present invention relates to a drive arrangement for a wheel unit of a running gear, in particular for a rail vehicle, comprising a wheel unit defining an axial direction and a radial direction, a first torque transmission device and a second torque transmission device. The first torque transmission device is connected in a torsionally rigid manner to the wheel unit and the second torque transmission device is connected in a torsionally rigid manner to the first torque transmission device using a connecting device such that an arrangement substantially coaxial to the axial direction is formed. The wheel unit has a wheel unit end section protruding, along the wheel axis, into a receptacle of the second torque transmission device. The present invention further relates to a running gear comprising such a drive arrangement as well as a method for assembling such a drive arrangement.

DESCRIPTION OF RELATED ART

Such a drive arrangement is known, for example, from EP 0 943 519 A2 (the entire disclosure of which is incorporated herein by reference), where the second torque transmission device formed by a hollow element of complex shape snugly sits on a complementarily shaped seat formed at the wheel unit end section. The axial contact force between the first and second torque transmission device is provided by a threaded element axially protruding through said second torque transmission device beyond an abutment for a nut to be screwed onto the threaded element. As the nut is tightened against the abutment axially toothed parts of the first and second torque transmission device are pressed against each other to provide a torsionally rigid connection. This configuration has the advantage that the location, where the force for connecting the first and second torque transmission device is generated, is different from the location where the torque is transmitted between the first and second torque transmission device. Hence, disassembly of the drive arrangement is easily feasible.

However, this known design solution has the disadvantage that, in case of a failure of the threaded connection, the second torque transmission device becomes loose and is very likely to damage the adjacent surfaces of the wheel set end section. As a consequence, extensive repair work would have to be done to both components.

SUMMARY OF THE INVENTION

Thus, it is the object of the present invention to provide a drive arrangement, a running gear, and a method of mounting a drive arrangement as described above, which do not show the disadvantages described above, or at least show them to a lesser extent, and which, in particular, provides, in a simple manner, protection against extensive damage of the participating components in case of failure of their connection.

The above objects are achieved starting from a drive arrangement according to the preamble of claim 1 by the features of the characterizing part of claim 1.

The present invention is based on the technical teaching that a simple protection against damage of the participating components in case of failure of their connection may be achieved if a protective element is placed between the wheel unit end section and the second torque transmission device. It has been found that sufficient space may be made available between the second torque transmission device and the wheel unit end section to place such a protective element having sufficient load taking capacity to permanently keep the second torque transmission device and the wheel unit end section from uncontrolledly contacting each other without being destroyed itself. Hence, in a very simple manner, a buffer and separator element may be formed, which, in case of failure, prevents damage to the participating component, in particular, to the typically machined surfaces of these components. Consequently, in case of failure of the connection, if at all, only the protective component has to be exchanged while all other components may be reused. This greatly reduces the repair effort necessary in case of such a failure.

Hence, according to one aspect, the present invention relates to a drive arrangement for a wheel unit of a running gear, in particular for a rail vehicle, comprising a wheel unit defining an axial direction and a radial direction, a first torque transmission device and a second torque transmission device. The first torque transmission device is connected in a torsionally rigid manner to the wheel unit, while the second torque transmission device is connected in a torsionally rigid manner to the first torque transmission device using a connecting device such that an arrangement substantially coaxial to the axial direction is formed. The wheel unit has a wheel unit end section protruding, along the wheel axis, into a receptacle of the second torque transmission device. A protective unit is arranged between the wheel unit end section and the second torque transmission device, the protective unit being configured to protect the wheel unit end section against damage by the second torque transmission device in case of failure of the connecting device.

To allow proper placement of an efficient protective unit in a simple manner, with preferred embodiments of the invention, a radial gap is formed between the wheel unit end section and the second torque transmission device, the protective unit, in the radial direction, at least partially filling the radial gap. In addition or as an alternative, the protective unit, in the axial direction, may at least partially fill the radial gap. In both cases it may be advantageous to fill the radial gap substantially completely to limit relative motion between the potential impact partners (i.e. the second torque transmission device and the wheel unit end section) in case of failure and, hence, to provide reliable damage protection.

It will be appreciated arrangement of the protective unit may be limited to one or more, eventually spatially separate locations, where, in case of a failure of the connecting device, an impact between the potential impact partners is to be expected. In other words, at locations where no mutual impact is to be expected, the radial gap may be empty. Hence, with certain embodiments of the invention, the protective unit may be made of two or more physically separate, eventually mutually spaced (in the axial and/or radial direction) components.

However, with certain variants of the invention, one single component or mutually contacting components may be used for a protective unit of larger size to provide particularly reliable protection under any circumstances. In particular, it is possible to use radially layered components, the different layers, eventually, being adapted to provide different functions such as, for example, surface layers providing optimized contact properties to the adjacent potential impact partners (e.g. avoiding contact corrosion etc.) and/or inner layers providing good damping properties etc. In very simple to handle variants, the protective unit is a monolithic component.

It will be appreciated that, basically, any suitable size of the protective unit may be chosen, in particular, as a function of the size and location of the areas of potential contact between the potential impact partners. Typically, in the axial direction, the radial gap has a gap length and the protective unit has a protective unit length. Preferably, the protective unit length is 40% to 100%, preferably 50% to 90%, more preferably, 70% to 85%, of the gap length in order to provide particularly reliable protection under any circumstances.

Furthermore, typically, in the radial direction, the radial gap has a gap width and the wheel unit end section, in an area of the radial gap, has a maximum and section diameter. Preferably, the gap width is 5% to 20%, preferably 7.5% to 17.5%, more preferably, 10% to 15%, of the maximum end section diameter. Such a configuration allows arrangement of particularly suitable protective units having sufficient absorption capacity to take up (preferably at least partially elastically and/or over a longer period) the loads acting between the potential impact partners in case of failure of their connection.

It will be appreciated that, the protective unit, in an intact state of the connection between the potential impact partners, does not necessarily have to contact both potential impact partners. Physical contact with only one of the potential impact partners may be sufficient. Hence, with certain embodiments of the invention, the protective unit contacts the wheel unit end section via an inner contact surface and/or contacts the second torque transmission device via an outer contact surface. Preferably, a transitional fit is provided over at least one of the inner contact surface and the outer contact surface, such that comparatively easy assembly is possible while, at the same time, providing sufficiently stable positioning of the protective unit.

With other preferred embodiments of the invention, the protective unit contacts the wheel unit end section, preferably with a press fit (for defined positioning) at the inner contact surface, while a radial gap is provided between the outer contact surface of the protective unit and the second torque transmission device (the radial gap may range from 0.5 mm to 3 mm, preferably from 1 mm to 2 mm). Similarly, with other preferred embodiments of the invention, the protective unit contacts the second torque transmission device, preferably with a press fit (for defined positioning) at the outer contact surface, while a radial gap is provided between the inner contact surface of the protective unit and the wheel unit end section (the radial gap may range from 0.5 mm to 3 mm, preferably from 1 mm to 2 mm).

Typically, in the axial direction, the radial gap has a gap length, the inner contact surface has an inner contact surface length and the outer contact surface has an outer contact surface length. Preferably, at least one of the inner contact surface length and the outer contact surface length is 30% to 100%, preferably 50% to 90%, more preferably, 70% to 85%, of the radial gap length, such that a comparatively large contact surface is achieved.

It will be appreciated that the respective contact surface does not necessarily have to be a continuous surface. Rather, adjacent sections of the contact surface may be separated by areas where no such contact exists between the protective unit and the adjacent component.

The protective unit may be made from any material suitable for taking up the impact loads in case of failure of the connection. Preferably, the material is suitable to distribute local loads exerted on it by one of the potential impact partners to such an extent that the loads transmitted to the other impact partner do note exceed the values causing damage to the latter.

Preferably, due to their energy absorption and damping properties, respectively, the protective unit is made from a plastic material. More preferably, the plastic material is one of a rubber material, a polyamide (PA) material, a polyethylene (PE) material and a polyurethane (PUR) material. These provide particularly suitable properties. Furthermore, at least some of these materials show good sliding properties. This is beneficial, since it reduces damage or wear due to frictional relative motion between the potential impact partners in case of failure.

The protective unit may be a simple hollow sleeve inserted between the potential impact partners. Typically, the wheel unit end section has an axial end surface facing away, in the axial direction, from the wheel unit. Preferably, the protective unit has a radial collar section covering a part of the axial end surface. This radial collar section may serve as an axial positioning reference for the protective unit. Preferably, the protective unit is connected to the wheel unit end section via the radial collar section, such that, in a simple manner, high positional stability of the components is achieved.

The torsionally rigid connection between the first torque transmission device and the second torque transmission device may be achieved by any suitable means. With advantageous variants of the invention, the first torque transmission device is connected to the second torque transmission device via a threaded connection arrangement between the second torque transmission device and the wheel unit end section. The threaded connection arrangement comprises at least one threaded element, the threaded element being arranged in the axial direction and cooperating with the wheel unit end section. Preferably, a torsionally rigid connection between the first torque transmission device and the second torque transmission device is provided via an axial toothing located at mutual contact sections of these components.

It will be appreciated that a plurality of such threaded elements may be used. With particularly simple and easy to manufacture variants of the invention, one single threaded element is used.

Typically, the threaded element, in the axial direction, has an effective length and, in the radial direction, has a nominal thread diameter. It should be noted that, in the sense of the present invention, the effective length designates the part of the threaded element serving to transmit the connection loads during operation. Preferably, the effective length is 500% to 900%, preferably 550% to 850%, more preferably, 650% to 750%, of the nominal thread diameter. By this means a comparatively compliant arrangement is achieved, which is able to provide sufficient tensile elongation under load without damage.

The threaded element may be of any suitable type. For example, it may be an entirely threaded element. With preferred embodiments showing particularly advantageous behavior under load, however, the threaded element comprises an inner threaded end, and outer threaded end and an unthreaded waisted shank section located between the inner threaded end and the outer threaded end. The dimensions of the different sections may be selected as needed. Preferably, the length of threaded end sections is selected such that (over the effective length of the threaded element) they substantially fully engage their threaded counterpart.

Particularly suitable solutions are achieved, where the threaded element, in the axial direction, has a total threaded element length and at least one of the inner threaded end and the outer threaded end, in the axial direction, has a thread length, the thread length being 10% to 35%, preferably 10% to 30%, more preferably, 15% to 25%, of the total threaded element length. With certain embodiments, allowing a particularly advantageous way of assembling the drive arrangement (as will be explained in greater detail below), the thread length of the outer threaded end is greater than the thread length of the inner threaded end, such that the outer threaded end readily provides an interface for tensioning tools or the like.

In addition or as alternative, the waisted section, in the axial direction, may have a waisted section length, the waisted section length being 25% to 55%, preferably 30% to 50%, more preferably, 35% to 45%, of the total threaded element length. Such a comparatively long waisted section (due to the notch free design of the waisted section) results in a beneficial comparatively compliant arrangement, which is able to provide sufficient tensile elongation under load without damage.

It will be appreciated that the threaded element may be designed as a screw with a threaded inner end section (screwed into the wheel unit end section) and an outer end section having a screw head resting against a corresponding abutment of the second torque transmission device. Preferably, the threaded connection arrangement comprises a nut element, the nut element cooperating with an outer threaded end of the threaded element and an abutment of the second torque transmission device, since such an arrangement provides more flexibility in tightening the connection.

Preferably, an interface part of the outer threaded end, in the axial direction protrudes beyond the nut element on a side of the nut element facing away from the wheel unit. The interface part, in the axial direction, preferably has an interface part length which is sufficient to connect the threaded element to a tensioning tool for imposing a tensile prestress onto the threaded element, thereby facilitating a specific method of mounting the components as will be explained in greater detail below.

With certain preferred embodiments of the invention, the second torque transmission device forms an outer receptacle receiving the nut element and the interface part of the threaded connection arrangement, thereby achieving protection of these vital components against damage. More preferably, the outer receptacle is closed by a cover element preventing free access to the nut element.

With certain preferred embodiments of the invention, the wheel unit end section has an axial recess, the axial recess extending in the axial direction and being open towards a free end of the wheel unit end section. The axial recess received a part of a connection arrangement connecting the second torque transmission device to the wheel unit end section. More precisely, the axial recess receives the part of the connection arrangement with a radial play in the radial direction. Due to this radial play it is possible to achieve a very compact arrangement with a sufficiently long free section of the connection arrangement, which is, due to the radial play, substantially exclusively under tensile stress. This again results in a beneficial comparatively compliant arrangement, which is able to provide sufficient tensile elongation under load without damage.

Preferably, an inner end, in particular and inner threaded end, of the part of the connection arrangement (received within the axial recess) is connected to the wheel unit end section in a region of an inner wall, in the axial direction, confining the recess at an inner and of the recess.

Particularly beneficial configurations forming suitably long free sections (as outlined above) are achieved, where the wheel unit and section, in an area of the protective element, has a maximum and section diameter, and the axial recess, in the axial direction, has an axial recess length, the axial recess length being 80% to 140%, preferably 90% to 130%, more preferably, 100% to 120% of the total threaded element length.

It will be appreciated that the present invention may be used in the context of arbitrary wheel unit designs. Hence, with certain preferred embodiments of the invention, the wheel unit end section is formed by a wheel unit shaft of the wheel unit. With other preferred embodiments of the invention, the wheel unit end section is formed by a hub of a wheel of the wheel unit.

The present invention furthermore relates to a running gear, in particular, for a rail vehicle, comprising a wheel unit and a drive unit, the wheel unit being driven by the drive unit via a drive arrangement according to the present invention. With such a running gear the embodiments and advantages as outlined above in the context of the drive arrangement may be realized to the same extent. Hence, reference is made to the explanations given above.

The present invention further relates to a method of assembling a drive arrangement according to the invention. According to this method, in a first assembly step, an inner in threaded end of a threaded element is threaded into the wheel unit end section. Furthermore the first torque transmission device and the second torque transmission device are brought into contact, such that the protective unit is arranged between the second torque transmission device and the wheel unit end section. Furthermore, the arrangement of the components is such that an outer threaded end of the threaded element, in the axial direction, protrudes beyond an abutment of the second torque transmission device facing away from the wheel unit end section. Furthermore, in the first assembly step, a nut element is screwed onto the outer threaded end such that an interface part of the outer threaded end, in the axial direction, protrudes beyond the nut element on a side of the nut element facing away from the wheel unit. It will be appreciated that all the partial steps of the first assembly step may be performed in arbitrary sequence.

Subsequently, in a second assembly step, a tensioning tool is connected to the interface part and used to impose, in the axial direction, a defined tensile prestress onto the threaded element, thereby axially elongating the threaded element by a defined value.

Subsequently, in a third assembly step, the nut element is further advanced on the outer threaded end and brought into contact with the abutment of the second torque transmission device. This may be done simply by hand without any tool, such that only comparatively low contact forces act between the nut and the mating abutment. In particular, compared to conventional tightening of a threaded connection using a wrench tool or the like, no noticeable or detrimental frictional motion occurs between the nut and the mating abutment. This is particularly beneficial in keeping eventual coatings (such as anti-corrosion coatings etc.) of the components free from damage.

Finally, in a fourth assembly step, the tensioning tool is released (thereby reducing the axial length of the threaded element) in order to press the nut element against the abutment using a tensile force generated by the threaded element, thereby firmly connecting the first torque transmission device and the second torque transmission device. Such a method has the great advantage that the participating components are exclusively set under well-defined tensile or compressive prestress while avoiding torsional stresses.

Further embodiments of the present invention will become apparent from the dependent claims and the following description of preferred embodiments which refers to the appended figures.

DETAILED DESCRIPTION OF THE INVENTION

Figure 1:
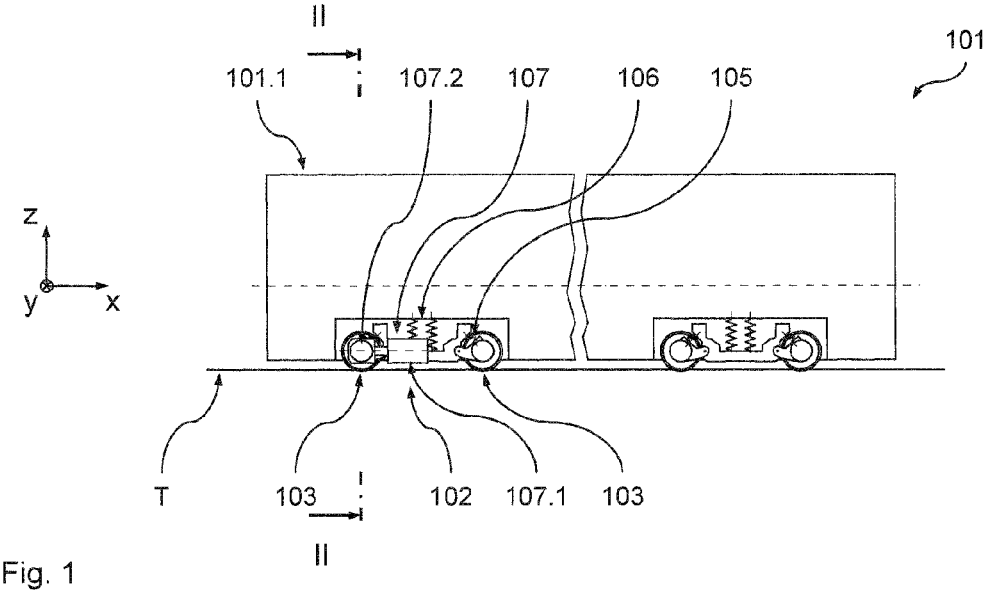
FIG. 1 is a schematic side view of a part of a preferred embodiment of a rail vehicle according to the present invention with a preferred embodiment of a running gear according to the present invention comprising a preferred embodiment of a drive arrangement according to the present invention.
Figure 2:
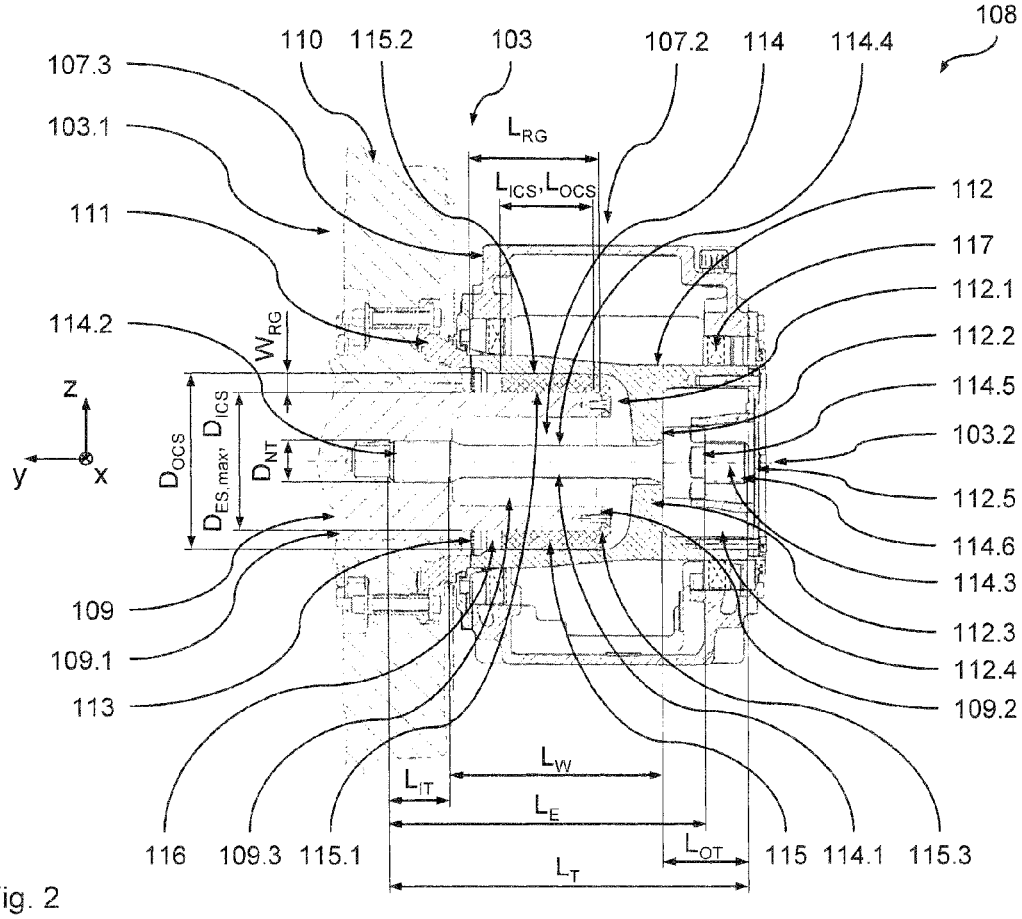
FIG. 2 is a schematic sectional view of a wheel unit of the running gear of FIG. 1 along line II-II of FIG. 1.

With reference to FIGS. 1 and 2 a preferred embodiment of a rail vehicle 101 according to the present invention comprising a preferred embodiment of a running gear 102 according to the invention will now be described in greater detail. In order to simplify the explanations given below, an xyz-coordinate system has been introduced into the Figures, wherein (on a straight, level track T) the x-axis designates the longitudinal direction of the rail vehicle 101, the y-axis designates the transverse direction of the rail vehicle 101 and the z-axis designates the height direction of the rail vehicle 101 (the same, of course, applies for the running gear 102). It will be appreciated that all statements made in the following with respect to the position and orientation of components of the rail vehicle, unless otherwise stated, refer to a static situation with the rail vehicle 101 standing on a straight level track under nominal loading.

The vehicle 101 is a low floor rail vehicle such as a tramway or the like. The vehicle 101 comprises a wagon body 101.1 supported by a suspension system on the running gear 102. The running gear 102 comprises two wheel units in the form of wheel sets 103 supporting a running gear frame 104 via a primary spring unit 105. The running gear frame 104 supports the wagon body via a secondary spring unit 106.

Each wheel set 103 of the running gear 102 defines an axial direction and a radial direction, wherein, in the static state, the axial direction is parallel to the transverse direction (y axis) and the radial direction lies in a plane perpendicular to the transverse direction (i.e. a plane parallel to the xz plane).

Each wheel set 103 is driven by a drive unit 107 laterally mounted to the running gear frame 104. Each drive unit comprises an electrical motor 107.1 connected to a gearbox 107.2, which in turn is connected to the respective wheel set 103. Motor torque transmission from the drive motor 107.1 to the wheel set 103 is provided via a preferred embodiment of a drive arrangement 108 according to the present invention.

As can be seen from FIG. 2, the drive arrangement 108 comprises a wheel unit end section 103.1 with an end part 109.1 of a wheel set shaft 109 torsionally rigidly connected to a wheel 110 of the wheel set 103. It will be appreciated however that, with other embodiments of the invention, any other suitable torsionally rigid connection may be chosen.

The drive arrangement 108 further comprises a first torque transmission device in the form of a ring-shaped collar element 111, which is connected in a torsionally rigid manner to the wheel 110. In the present example, connection is made via a plurality of axially arranged screws evenly distributed at the circumference of the collar 111. It will be appreciated however that, with other embodiments of the invention, any other suitable torsionally rigid connection may be chosen.

The drive arrangement 108 further comprises a second torque transmission device in the form of a hollow shaft element 112. The hollow shaft element 112 is connected in a torsionally rigid manner to the collar 111, such that the shaft end part 109.1 axially protrudes into an inner receptacle 112.1 of the hollow shaft element 112. Hence, an arrangement is formed, in which the wheel unit end section 103.1, the collar element 111 and the hollow shaft element 112 are substantially coaxial to an axis of rotation 103.2 of the wheel set 103 and to the axial direction, respectively.

The torsionally rigid connection between the collar element 111 and the hollow shaft element 112 is provided via an axial toothing 113 at their contact surfaces. It will be appreciated however that, with other embodiments of the invention, any other suitable torsionally rigid connection may be chosen.

The axial contact force between the shaft element 112 and the collar element 111 is generated by a threaded connecting device 114 cooperating with the wheel shaft end part 109.1 and an abutment 112.2 formed at a radial inner wall 112.3 of the hollow shaft element 112 as will be explained in greater detail below.

A toothed wheel (not shown) forming part of the gearing of the gearbox 107.2 is mounted to the outer circumference of the hollow shaft element 112, such that the motor torque of the motor 107.1 can be transmitted, via the gearing of the gearbox 107.2, the hollow shaft element 112 and the, element 111 to the wheel 110 and the wheel set shaft 109 of the wheel set 103. A housing 107.3 of the gearbox 107.2 is supported on the hollow shaft element 112 via rotational bearings (only highly schematically indicated in FIG. 2 by dashed contours 117).

In case of a failure of the connecting device 114, not least due to the considerable weight of the gearbox 107.2, the hollow shaft element 112 (with the gearbox 107.2 sitting on it) as known from conventional designs would drop down onto the shaft end part 109.1 received within the inner receptacle 112.1 of the hollow shaft element 112. Such an impact could cause considerable damage to both impact partners, i.e. the shaft end part 109.1 and the hollow shaft element 112. At best, this could lead to considerable frictional wear. Typically, however, it is likely that the two components would contact under a certain cant which would lead to a highly locally concentrated introduction of the impact loads leading to local damage of the impact partners. Eventually even uncontrolled relative motion between the two impact partners with multiple subsequent impacts could occur, thereby further aggravating the damage.

To prevent such a scenario, according to the present invention, a protective unit in the form of a cylindrical protective sleeve 115 is arranged in a radial gap 116 formed between the wheel set end section 103.1 and the hollow shaft element 112. The protective sleeve is configured to protect the wheel set end section 103.1, in particular, the shaft end section 109.1, and the hollow shaft element 112 in case of failure of the connecting device 114.

The protective sleeve 115 forms a buffer and separator element, which, in case of such a failure of the connecting device 114, prevents damage to the potential impact partners 103.1, 112. Consequently, in case of failure of the connection device 114, if at all, only the protective sleeve 115 has to be exchanged while all other components may be reused. This greatly reduces the repair effort necessary in case of such a failure.

As can be seen from FIG. 2, in the radial direction, the protective sleeve 115, along its axial dimension, fully fills the radial gap 116, such that the protective sleeve 115 has physical contact with the shaft end section 109.1 at an inner contact surface 115.1 and has physical contact with the hollow shaft element 112 at an outer contact surface 115.2. In the present example, at both contact surfaces 115.1 and 115.2, a transitional fit is provided, such that comparatively easy assembly is possible while, at the same time, providing sufficiently stable positioning of the protective sleeve 115. It will be appreciated however that, with other embodiments of the invention, another type of fit (e.g. a loose fit or a press fit) may be selected as needed at any of these two contact surfaces 115.1 and 115.2.

The protective sleeve 115, in the present example, is a generally hollow cylindrical component, wherein, in the axial direction, the inner contact surface length $L_{ICS}$ of the inner contact surface 115.1 and the outer contact surface length $L_{OCS}$ of the outer contact surface 115.2 are substantially the same (i.e. $L_{ICS}=L_{OCS}$). It will be appreciated however that, with other embodiments of the invention, e.g. with radially stepped designs of the protective sleeve 115, these contact surface dimensions may differ from one another.

In the present embodiment, in the axial direction, the protective sleeve 115 fills a major part of the radial gap 116. More precisely, while the radial gap 116 has a gap length $L_G$, the inner contact surface length $L_{ICS}$ and the outer contact surface length $L_{OCS}$ each are 80% of the radial gap length $L_{RG}$, such that a comparatively large contact surface is achieved. Hence, in other words, a protective unit length $L_S$ which, in the present case, corresponds to the inner and outer contact surface length $L_{ICS}$ and $L_{OCS}$, also is 80% of the radial gap length $L_{RG}$. With such a configuration, a comparatively large protected area is achieved, which provides particularly reliable damage protection under any circumstances.

Figure 3:
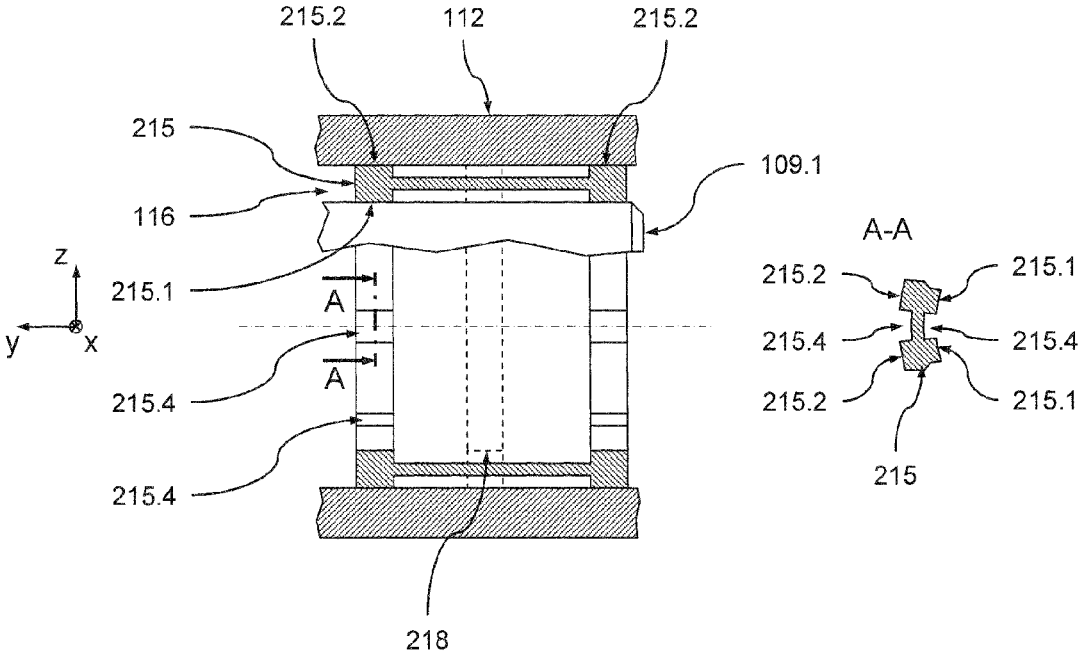
FIG. 3 is a schematic sectional view of a further protective element which may be used in the running gear of FIG. 1.

It will be appreciated that the respective contact surface does not necessarily have to be a continuous surface. Rather, adjacent sections of the contact surface may be separated by areas where no such contact exists as it is shown, for example, in FIG. 3. More precisely, FIG. 3 schematically shows a design of a protective sleeve 215, which replaces protective sleeve 115 in the embodiment of FIG. 2.

The only difference between protective sleeve 215 and protective sleeve 115 is that the protective sleeve 215 has an axially and radially stepped inner contact surface 215.1 as well as an axially and radially stepped outer contact surface 215.2, such that contact between the protective sleeve 215 and the shaft end section 109.1 and the hollow shaft element 112 is only provided at the axial ends of the protective sleeve 215 at circumferentially adjacent shell sections separated by axial grooves 215.4.

It will be appreciated that such axially spaced contact areas may as well be provided only at the inner contact surface or the outer contact surface. Moreover, one or more further contact areas may be formed between the axial ends of the protective sleeve 215 as it is indicated by the dashed contour 218.

In the present example, in the radial direction, the radial gap 116 has a gap width $W_{RG}$, while the wheel set end section 103.1, more precisely the shaft end part 109.1, in the area of the radial gap 116, has a maximum end section diameter $D_{Es,max}$. The gap width is 12.5% of the maximum end section diameter $D_{ES,max}$. Such a configuration allows arrangement of a protective sleeve 115, which has sufficient absorption capacity to take up (preferably at least partially elastically and/or over a longer period) the loads acting between the potential impact partners 103.1 and 112 in case of failure of the connecting the device 114.

In the present example, the protective sleeve 115 is a monolithic component made from a material suitable for taking up the impact loads in case of failure of the connection via connecting device 114. More precisely, the material is suitable to distribute local loads exerted on it by the potential impact partners 103.1 and 112 to such an extent that the loads transmitted to the respective other impact partner 112 and 103.1 do note exceed the values causing damage to the latter.

Due to the favorable energy absorption and damping properties, respectively, the protective sleeve 115 is made from a plastic material. More precisely, the plastic material is one of a rubber material, a polyamide (PA) material, a polyethylene (PE) material, a polyurethane (PUR) material and a fiber reinforced composite material. These provide particularly suitable properties. Furthermore, at least some of these materials show good sliding properties. This is beneficial, since it reduces damage or wear due to frictional relative motion between the hollow shaft element 112 and the shaft end part 109.1 in case of failure.

Figure 4:
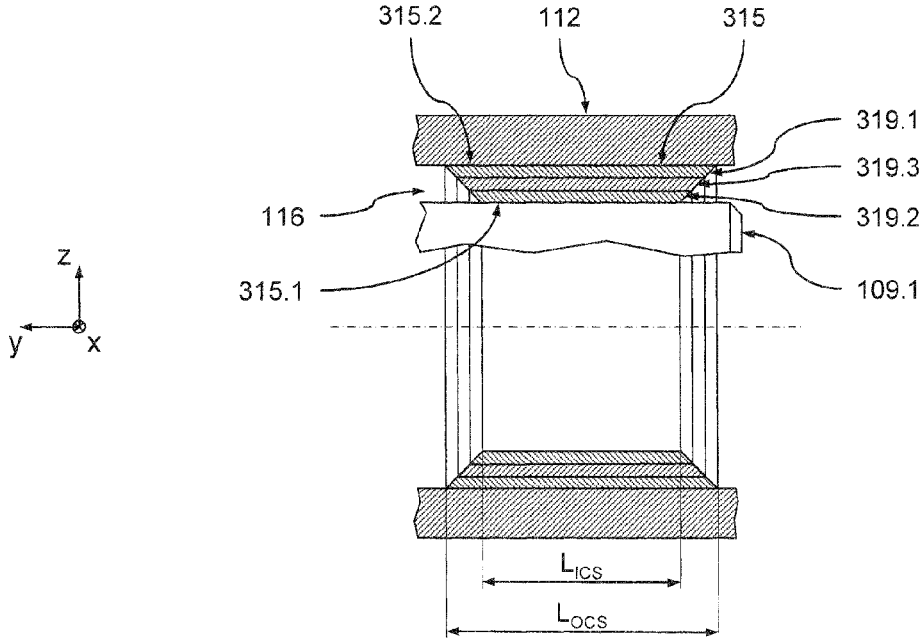
FIG. 4 is a schematic sectional view of a further protective element which may be used in the running gear of FIG. 1.

It will be appreciated that radially layered components may also be used as it is shown, for example, in FIG. 4. More precisely, FIG. 4 schematically shows a design of a protective sleeve 315, which replaces protective sleeve 115 in the embodiment of FIG. 2.

As can be seen from FIG. 4, one difference between protective sleeve 315 and protective sleeve 115 is that the protective sleeve 315 consists of three different layers 319.1, 319.2 and 319.3 adapted to provide different functions. More specifically, surface layers 319.1 and 319.2 provide optimized contact properties (e.g. avoiding contact corrosion etc.) to the adjacent the hollow shaft element 112 and shaft end section 109.1, respectively. The inner layer 319.3 provides particularly good damping properties.

A further difference between the protective sleeve 315 and protective sleeve 115 is that the protective sleeve 315 has conically shaped ends, such that the inner contact surface 315.2 is smaller than the outer contact surface 315.1 (i.e. $L_{ICS}<L_{OCS}$). Such a design may be advisable under specific load conditions to be expected in case of failure of the connecting device 114.

Reverting back to FIG. 2, the protective sleeve 115 has a radial collar section 115.3 covering a part of an axial end surface 109.2 of the shaft end part 109.1, axially facing away from the wheel unit 103. This radial collar section 115.3 serves as an axial positioning reference for the protective sleeve 115. Moreover, the protective sleeve 115 is firmly connected to the shaft end part 109.1 via the radial collar section 115.3 and a plurality of screws, such that, in a simple manner, high positional stability of the components is achieved.

As can be further seen from FIG. 2, the connection device comprises threaded element in the form of a threaded bolt 114.1 arranged in the axial direction. The threaded bolt 114.1 has an inner threaded end 114.2, and outer threaded end 114.3 and an unthreaded waisted shank section 114.4 located between the threaded ends 114.1 end 114.2.

The inner threaded end 114.2 is fully screwed into a corresponding axial threaded bore within an inner wall of the shaft end section 109.1, which (in the axial direction) confines an inner end of an axial shaft receptacle 109.3 formed within the shaft end section 109.1. The waisted shank section 114.4 is received, with radial play, within the axial shaft receptacle 109.3 formed by a corresponding axial recess of the shaft end section 109.1 open towards the free end of the shaft end section 109.1 facing away from the wheel set 103.

The threaded bolt 114.1, in the axial direction, protrudes through a hole in the radial separation wall 112.3 forming the abutment 112.2, such that a nut 114.5 of the connecting device 114 may be screwed on the outer threaded end 114.3 to be in contact with the abutment 112.2.

Due to the radial play of the waisted shank section 114.4 within the shaft receptacle 109.3 it is not only possible to achieve a very compact arrangement. A further advantage is that a comparatively long free section of the threaded bolt 114.1, namely the shank section 114.4, is substantially exclusively under tensile stress. This again results in a beneficial comparatively compliant connection, which is able to provide sufficient tensile elongation of the threaded bolt (in particular due to deformation of the waisted shank section 114.4) under load without a risk of damage.

More specifically, the threaded bolt 114.1, has an effective length $L_E$ (in the axial direction and designating the part of the threaded bolt 114 serving to transmit the connection loads during operation) and a nominal thread diameter $D_{NT}$ (in the radial direction). In the present example, the effective length $L_E$ is 725% of the nominal thread diameter $D_{NT}$. By this means a comparatively compliant arrangement is achieved, which is able to provide sufficient tensile elongation under load without damage. It should be noted in this context that, in cases where the two threaded end sections have different nominal thread diameters, preferably the larger nominal thread diameter is relevant.

In the present example, the threaded bolt 114.1, in the axial direction, has a total threaded element length $L_T$, while the inner threaded end 114.2 has an inner thread length $L_{IT}$, which is 16% of the total threaded element length $L_T$, and the outer threaded end 114.3 has an outer thread length $L_{OT}$, which is 24% of the total threaded element length $L_T$.

Furthermore, in the present example, the waisted section 114.4, in the axial direction, has a waisted section length $L_W$, which is 40% of the total threaded element length $L_T$. Such a comparatively long waisted section 114.4 (due to the notch free design of the waisted section) results in a beneficial comparatively compliant arrangement, which is able to provide sufficient tensile elongation of the threaded bolt 114.1 under load without damage.

In the present example, a particularly beneficial configuration with a suitably long free section (as outlined above) of the threaded bolt is achieved, with a configuration where axial recess length of the axial shaft receptacle 109.3 is 110% of maximum end section diameter of the shaft end section 109.1 (in the area of the protective sleeve 115).

As can be further seen from FIG. 2, an interface part 114.6 of the outer threaded end 114.3, in the axial direction protrudes beyond the nut 114.5 on a side of the nut 114.5 facing away from the wheel unit 103. In the present example, the interface part 114.6, in the axial direction, has an interface part length which is sufficient to connect the threaded bolt 114.1 to a tensioning tool (not shown) for imposing a tensile prestress onto the threaded threaded bolt 114.1, thereby facilitating a specific method of mounting the components as will be explained in greater detail below.

The nut 114.5 and the interface part 114.6 are received within an outer receptacle 112.4 of the hollow shaft element 112, which is furthermore closed by a cover 112.5, such that these vital components are protected from damage.

Assembly of the configuration as described above, in the present example, is performed according to preferred embodiment of a method of assembling a drive arrangement according to the invention, which will be described in the following.

In a partial step of a first assembly step, after the protective sleeve 115 has been connected to the shaft end section 109.1, the inner threaded end 114.2 of the threaded bolt 114.1 is screwed into the mating threaded hole in the shaft end section 109.1.

Subsequently, in a partial step of the first assembly step, the collar element 111 and the hollow shaft element 112 are brought into contact in the region of the axial toothing 113, such that the protective sleeve 115 is arranged between the shaft end section 109.1 and the hollow shaft element 112. Furthermore, at this stage, the outer threaded end 114.3 of the threaded bolt 114.1 protrudes beyond the abutment 112.2 of the hollow shaft element 112.

In a further partial step of the first assembly step, the nut 114.5 is screwed onto the outer threaded end 114.3 such that the interface part 114.6 of the outer threaded end 114.3 axially protrudes beyond the nut 114.5. It will be appreciated that all the partial steps of the first assembly step may be performed in arbitrary sequence.

Subsequently, in a second assembly step, a tensioning tool (not shown) is connected to the interface part 114.6 (typically using the threads of interface part 114.6). Afterwards, the tensioning tool is used to impose (in the axial direction) a defined tensile prestress onto the threaded bolt 114.1, thereby axially elongating the threaded bolt 114.1 by a defined value.

Subsequently, in a third assembly step, the nut 114.5 is further advanced on the outer threaded end 114.3 and brought into contact with the abutment 112.2 of the hollow shaft element 112. This may be done simply by hand without any tool, such that only comparatively low contact forces act between the nut 114.5 and the mating abutment 112.2. In particular, compared to conventional tightening of a threaded connection using a wrench tool or the like, no noticeable or detrimental frictional motion occurs between the nut 114.5 and the mating abutment 112.2. This is particularly beneficial in keeping eventual coatings (such as anti-corrosion coatings etc.) of the components free from damage.

Finally, in a fourth assembly step, the tensioning tool is released (thereby reducing the axial length of the threaded bolt 114.1) in order to press the nut 114.5 against the abutment 112.2 using a tensile force generated by the threaded bolt 114.1, thereby firmly connecting the collar element 111 and the hollow shaft element 112. This method of assembly has the great advantage that the participating components are exclusively set under well-defined tensile or compressive prestress while avoiding torsional stresses.

It will be appreciated that such an arrangement and assembly method furthermore has the great advantage that assembly and, in particular, disassembly from the arrangement are very simple to perform, thereby greatly facilitating maintenance and repair.

Although the present invention in the foregoing has only a described in the context of low-floor rail vehicles, it will be appreciated, however, that it may also be applied to any other type of rail vehicle in order to overcome similar problems with respect to a simple solution for reducing the risk of damage from the components of the drive arrangement in case of failure of a connecting element.

The invention claimed is:

1. A drive apparatus for a wheel unit of a running gear for a rail vehicle, comprising:

a wheel unit defining an axial direction and a radial direction;

a first torque transmission device; and a second torque transmission device;

wherein said first torque transmission device is connected in a torsionally rigid manner to said wheel unit and said second torque transmission device is connected in a torsionally rigid manner to said first torque transmission device using a connecting device, wherein an arrangement substantially coaxial to said axial direction is formed;

wherein said wheel unit has a wheel unit end section protruding, along said wheel axis, into a receptacle of said second torque transmission device;

wherein a protective unit is arranged between said wheel unit end section and said second torque transmission device; and wherein said protective unit is configured to protect said wheel unit end section against damage by said second torque transmission device in case of failure of said connecting device.

2. The drive apparatus according to claim 1, wherein, a radial gap is formed between said wheel unit end section and said second torque transmission device;

wherein said protective unit, in said radial direction, at least partially, fills said radial gap, and wherein said axial direction, at least partially filling said radial gap.

3. The drive apparatus according to claim 2, wherein, said radial gap, in said axial direction, has a gap length;

wherein said protective unit, in said axial direction, has a protective unit length; and wherein said protective unit length is 40% to 100%, of said gap length.

4. The drive apparatus according to claim 2, wherein, said radial gap, in said radial direction, has a gap width;

wherein said wheel unit end section, in an area of said radial gap, has an end section diameter; and wherein said gap width is 5% to 20% of said end section diameter.

5. The drive apparatus according to claim 2, wherein said protective unit contacts said wheel unit end section via an inner contact surface provided with a transitional fit or contacts said second torque transmission device via an outer contact surface provided with a transitional fit;

wherein said radial gap, in said axial direction, has a gap length, wherein said inner contact surface in said axial direction, has an inner contact surface length;

wherein said outer contact surface in said axial direction, has an outer contact surface length; and wherein at least one of said inner contact surface length and said outer contact surface length is 30% to 100%, of said radial gap length.

6. The drive apparatus according to claim 1, wherein, said protective unit is made from a plastic material; and wherein said plastic material is one of a rubber material, a polyamide (PA) material, a polyethylene (PE) material, a polyurethane (PUR) material, and a fiber reinforced composite material; and wherein said protective unit being a monolithic component.

7. The drive apparatus according to claim 1, wherein, said wheel unit end section has an axial end surface facing away, in said axial direction, from said wheel unit;

wherein said protective unit has a radial collar section covering a part of said axial end surface; and wherein said protective unit is connected to said wheel unit end section via said radial collar section.

8. The drive apparatus according to claim 1, wherein, said first torque transmission device is connected to said second torque transmission device via a threaded connection arrangement between said second torque transmission device and said, wheel unit end section;

wherein said threaded connection arrangement has at least one threaded element;

wherein said at least one threaded element is arranged in said axial direction and cooperating with said wheel unit end section; and wherein a torsionally rigid connection between said first torque transmission device and said second torque transmission device, is provided via an axial toothing.

9. The drive apparatus according to claim 8, wherein, said at least one threaded element, in said axial direction, has an effective length and, in said radial direction, has a nominal thread diameter;

wherein said effective length is 500% to 900% of said nominal thread diameter.

10. The drive apparatus according to claim 8, wherein said at least one threaded element comprises an inner threaded end, and outer threaded end and an unthreaded waisted shank section located between said inner threaded end and said outer threaded end;

wherein said at least one threaded element, in said axial direction, has a total threaded element length;

wherein at least one of said inner threaded end and said outer threaded end, in said axial direction, has a thread length, said thread length being 10% to 35% of said total threaded element length, said thread length of said outer threaded end, being greater than said thread length of said inner threaded end; and wherein said unthreaded waisted shank section, in said axial direction, has a waisted section length, said waisted section length being 25% to 55% of said total threaded element length.

11. The drive apparatus according to claim 10, wherein, said wheel unit end section has an axial recess;

wherein said axial recess extends in said axial direction and being open towards a free end of said wheel unit end section;

wherein said axial recess receives a part of a connection arrangement connecting said second torque transmission device to said wheel unit end section;

wherein said axial recess receives said part of said connection arrangement with a radial play in said radial direction;

wherein an inner end of said part of said connection arrangement is connected to said wheel unit end section in a region of an inner wall, in said axial direction, confining said axial recess at an inner end of said axial recess;

wherein said wheel unit end section, in an area of said protective unit, has an end section diameter, and said axial recess, in said axial direction, has an axial recess length, said axial recess length being 80% to 140% of said total threaded element length.

12. The drive apparatus according to claim 8, wherein, said threaded connection arrangement comprises a nut element;

wherein said nut element cooperates with an outer threaded end of said threaded element and an abutment of said second torque transmission device;

wherein an interface part of said outer threaded end, in said axial direction protrudes beyond said nut element on a side of said nut element facing away from said wheel unit:

wherein said interface part, in said axial direction has an interface part length sufficient to connect said threaded element to a tensioning tool for imposing a tensile prestress onto said threaded element; and wherein said second torque transmission device, in particular, forms an outer receptacle receiving said nut element and said interface part of said threaded connection arrangement, said outer receptacle, being closed by a cover element preventing free access to said nut element.

13. The drive apparatus according to claim 1, wherein, said wheel unit end section is formed by a wheel unit shaft of said wheel unit or by a hub of a wheel of said wheel unit.

14. A running apparatus, for a rail vehicle, comprising:

a wheel unit defining an axial direction and a radial direction and a drive unit;

wherein said wheel unit is driven by said drive unit via a drive apparatus, wherein the drive apparatus comprises:

a first torque transmission device; and a second torque transmission device;

wherein said first torque transmission device is connected in a torsionally rigid manner to said wheel unit and said second torque transmission device is connected in a torsionally rigid manner to said first torque transmission device using a connecting device, wherein an arrangement substantially coaxial to said axial direction is formed;

wherein said wheel unit has a wheel unit end section protruding, along said wheel axis, into a receptacle of said second torque transmission device;

wherein a protective unit is arranged between said wheel unit end section and said second torque transmission device; and wherein said protective unit is configured to protect said wheel unit end section against damage by said second torque transmission device in case of failure of said connecting device.

15. A method of assembling a drive apparatus, comprising, threading an inner threaded end of a threaded element into a wheel unit end section to bring a first torque transmission device and a second torque transmission device into contact, wherein a protective unit is arranged between said second torque transmission device and said wheel unit end section and an outer threaded end of said threaded element, in an axial direction, protrudes beyond an abutment of said second torque transmission device facing away from said wheel unit end section;

screwing a nut element onto said outer threaded end such that an interface part of said outer threaded end, in said axial direction; protrudes beyond said nut element on a side of said nut element facing away from said wheel unit;

connecting a tensioning tool to said interface part; imposing, in said axial direction, a defined tensile prestress onto said threaded element via the tensioning tool;

advancing said nut element further on said outer threaded end; bringing said nut element into contact with said abutment of said second torque transmission device; and releasing said tensioning tool to press said nut element against said abutment using a tensile force generated by said threaded element, which firmly connects said first torque transmission device and said second torque transmission device.

* * * * *